United States Patent [19]

Hulick

[11] 4,303,911

[45] Dec. 1, 1981

[54] REMOTE CONTROL DIGITALLY ENCODED ELECTRONIC SWITCH

[76] Inventor: Timothy P. Hulick, 1280 Southfield Pl., Virginia Beach, Va. 23452

[21] Appl. No.: 61,946

[22] Filed: Jul. 30, 1979

[51] Int. Cl.[3] ..... H04B 7/00

[52] U.S. Cl. ..... 340/825.69; 340/359; 340/539; 455/152

[58] Field of Search ..... 340/32, 307, 345, 359, 340/539, 694; 455/92, 136, 152

[56] References Cited

U.S. PATENT DOCUMENTS 4,063,410 12/1977 Welling ..... 340/539

*Primary Examiner*—Alvin H. Waring

*Attorney, Agent, or Firm*—Oltsch, Knoblock & Hall

[57] ABSTRACT

A transmitter is preprogrammed to transmit a digital binary bit time sequence code of a selected number of bits each occupying approximately 12 milliseconds of time. A receiver decodes the transmitted bit code within a fifth of a second to cause actuation of the switch, all within a one second lockout to prevent receipt of an additional code by an intruder or unauthorized user.

1 Claim, 3 Drawing Figures

REMOTE CONTROL DIGITALLY ENCODED ELECTRONIC SWITCH

SUMMARY OF THE INVENTION

This invention relates to an electronic switch which is remotely actuated by digital code and will have specific but not limited application to lock openers for automobile doors, trunk lids, security or vault doors, and other securable means of access.

In this invention a transmitter is preprogrammed to transmit a digital binary bit timed sequence code, which in the preferred embodiment consists of fourteen bits. This code is transmitted in approximtely 1/5 second of time and is picked up for decoding by a receiver located preferably near the location of the switch. The code bits cause the actuation of the switch within approximately 1/5 of a second, well within a timed interval lockout, in a preferred embodiment of one second, to prevent intruders or other unauthorized users from inserting a second code into the receiver.

Heretofore, electronic locks, which are practical applications for switches, have been of the simple on-off variety actuated without the use of encoding by a radio transmitter in the vicinity. More sophisticated systems make use of a two tone encoding similar to the dialing system utilized in the touch tone telephone system. Codes of this nature which rely only on tone pairs in sequence are relatively simple to duplicate. In other systems, such as that disclosed in U.S. Pat. No. 3,953,991, the code consists of a selected number of pulses of constant duration and of variable repetition rates. In the subject invention, the number of code bits, the duration of each code bit and even the frequency of the code transmission can be varied, thereby creating a high security code system having an extremely low probability of random duplication.

Accordingly, it is an object of this invention to provide an electronic switch which is remotely controlled through a multiple bit digital code.

Another object of this invention is to provide a remoted controlled electronic lock opener of rapid operation and of high security.

Still another object of this invention is to provide an electronic switch which is remotely controlled and which is of reliable operation.

Still another object of this invention is to provide a remote control digitally encoded electronic door lock opener having an extremely low probability of code duplication.

Other objects of this invention will become apparent upon a reading of the invention's description.

BRIEF DESCRIPTION OF THE DRAWINGS

A preferred embodiment of this invention has been chosen for purposes of illustration and description wherein.

DESCRIPTION OF THE PREFERRED EMBODIMENT

The preferred embodiment illustrated is not intended to be exhaustive or to limit the invention's precise form disclosed. It is chosen and described in order to best explain the principles of the invention and their application and use to better enable others skilled in the art to best utilize the invention.

TRANSMITTER AND ENCODER

Figure 1:
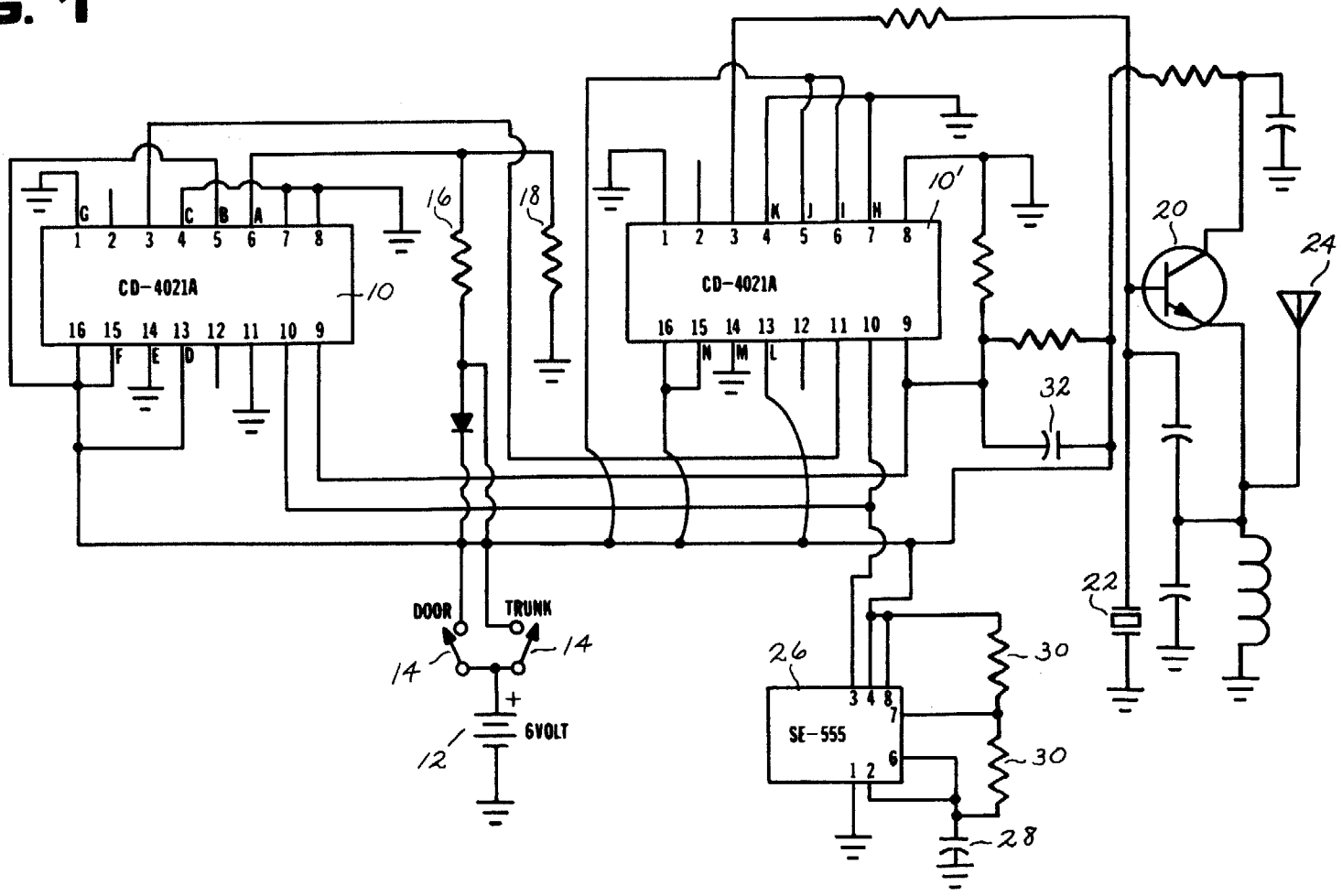
FIG. 1 is a circuit diagram of a transmitter and encoder utilized with the switch mechanism of this invention.

The transmitter and encoder shown in FIG. 1 is preprogrammed to transmit a digital, binary bit timed sequence code of fourteen bits. Each bit, whether it is a logic one or a logic zero, is designed to occupy approximately 12 milliseconds of time. Therefore, the transmission of fourteen bits will acquire a transmission time of nearly two hundred milliseconds. Logic one as used herein refers to the presence of a voltage while logic zero as used herein refers to the absence of a voltage. While fourteen bits are utilized in the code of the preferred embodiment, it is to be understood that the number of bits can be varied to suit the situation. Both the transmitter shown in FIG. 1 and the receiver shown in FIG. 2 make use of one of ten available eight KHz wide frequency channels in the 49.82 to 49.9 MHz frequency band. The particular frequency channel to be utilized for a particular code can be varied so as to again expand the security of the switch mechanism.

Included in the circuit of FIG. 1 are two parallel to serial connected shift registers 10 and 10' having A-N lettered pins which are representative of the fourteen bit code transmitted serially N to A. Those bits of the code which are to be representative of a logic one will be tied to a supply voltage, which in this case is a six volt battery 12. Those lettered bits of the code which are to assume a logic zero will be grounded. In the code, the pin represented by the A bit will be optionally connected either to the voltage supply 12 or to ground through switches 14 to permit the switching mechanism to be optionally utilized for two functions, such as in the preferred embodiment to open a car door (logic zero) or a trunk (logic one). If there is to be only a single use of the switch mechanism, there need be only a single switch 14. Resistors 16 and 18 serve as voltage dividers so that the A bit may be properly programmed.

The pin representing the B bit is always logic one, the pin representing the C bit is always a logic zero and the pin representing the N bit is always a logic one for reasons which will be apparent later. The remaining bits D-M have their associated register pins arbitrarily wired or tied to produce the desired code. For purposes of explanation the following code is selected:

A-logic one or zero, B-logic one, C-logic zero, D-logic one, E-logic zero, F-logic one, G-logic zero, H-logic zero, I-logic one, J-logic one, K-logic zero, L-logic one, M-logic zero, and N-logic one. The pairs of registers 10 and 10' have been wired accordingly.

The carrier frequency for the transformer is provided by transistor 20 and a quartz crystal 22. When modulated by the selected code, the transistor transmits through an antenna 24 a carrier of approximately 15 milliwatts per each logic one bit for a duration of 12 milliseconds and will remain off for each logic zero bit for a like 12 milliseconds of duration. The current to turn on transistor 20 is provided by the bit output of registers 10 and 10' through pin 3 of register 10'. Thus, for each logic one, the transmitter oscillator will be caused to oscillate and for each logic zero the oscillator will shut off. The clocked gating for the serial outputs of the code bit N-A sequence is provided by a free-running multi-vibrator or rectangular wave oscillator 26. The periood of oscillation of multi-vibrator 26 is set by capacitor 28 and associated resistors 30. Multi-vibrator 26 begins oscillation immediately upon actuation of a switch 14. The code is immediately programmed into shift registers 10 and 10' in parallel fashion. Upon actuation of multi-vibrator 26, the fourteen code bits are clocked serially out of registers 10, 10' to cause the resultant oscillatory action of transistor 20 in conjunction with crystal 22 depending upon the logic one or logic zero designation of each bit. In the transmitter and encoder of FIG. 1, the clocked out order of the bits is N through A.

Figure 2:
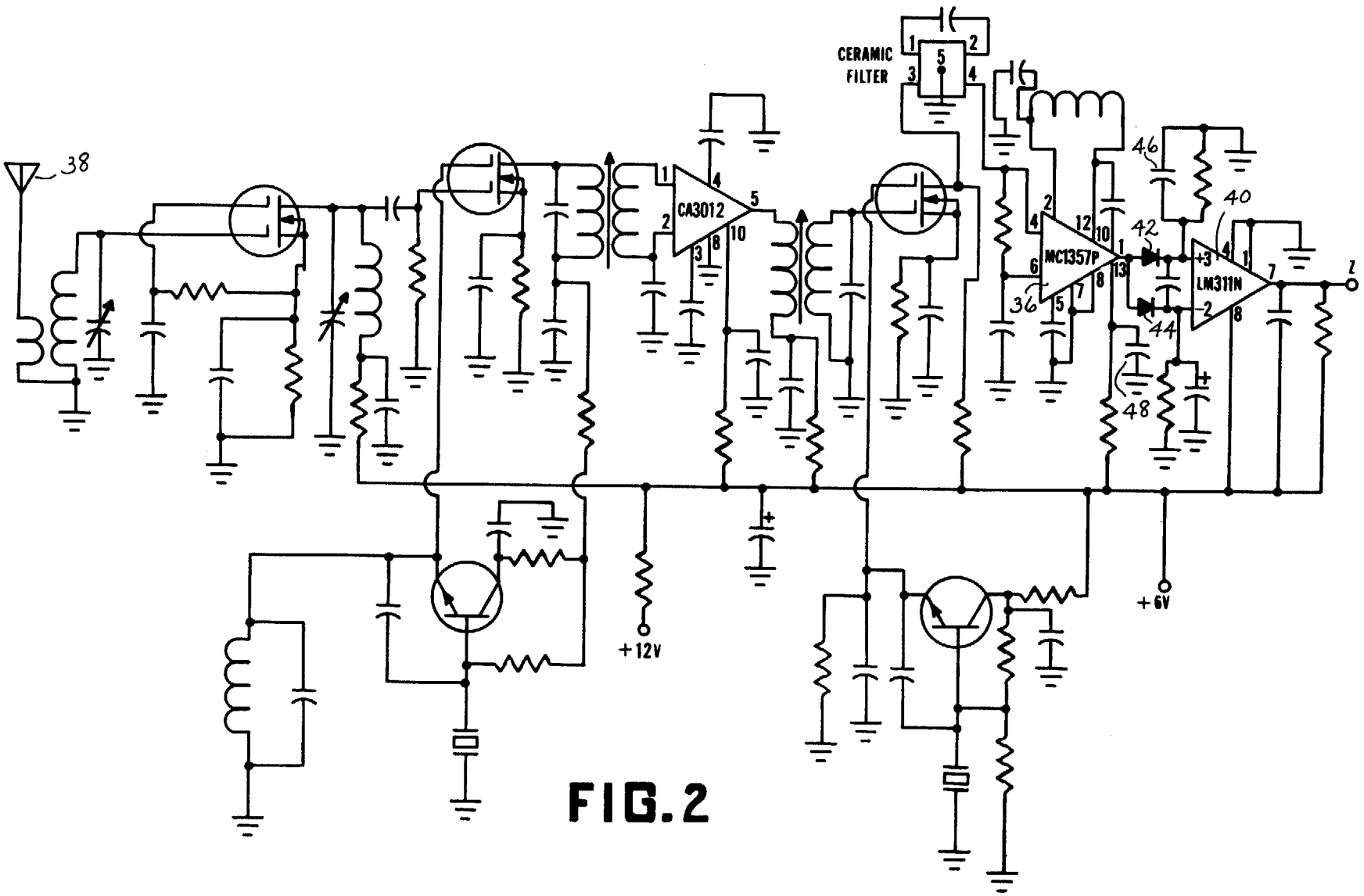
FIG. 2 is a circuit diagram of a radio receiver utilized with the switch mechanism of this invention.

After the fourteen bit code has been clocked from registers 10 and 10' and transmitted by way of antenna 24 to the receiver of FIG. 2, the oscillator of the transmitter will terminate automatically due to the grounding of pin 7, the serial input in register 10. Once switch 14 is released, battery source 12 is disconnected from the entire transmitter to terminate operation. The width of each gated out bit as provided by multi-vibrator 26 was chosen in the preferred embodiment to be approximately 12 milliseconds so that all fourteen bits of the code take approximately 1/5 of a second to be gated completely out. Registers 10 and 10' are reset for a subsequent transmission at the instant one of the switches 14 is pushed to connect the power supply 12 into the transmitter circuit. At this moment capacitor 32 acts as an instantaneous short circuit causing connected pin 9, the program enable input pin, of each register 10 and 10' to be charged or brought to a logic one condition, so that it can accept the program. Once capacitor 32 charges, it becomes an open circuit causing pins 9 of the registers to shift to a logic zero state. The shifting of pins 9 from a logic one to a logic zero state occurs in approximately one millisecond, but such time is sufficiently long enough to again gate in the preset code into the registers.

RECEIVER

Figure 3:
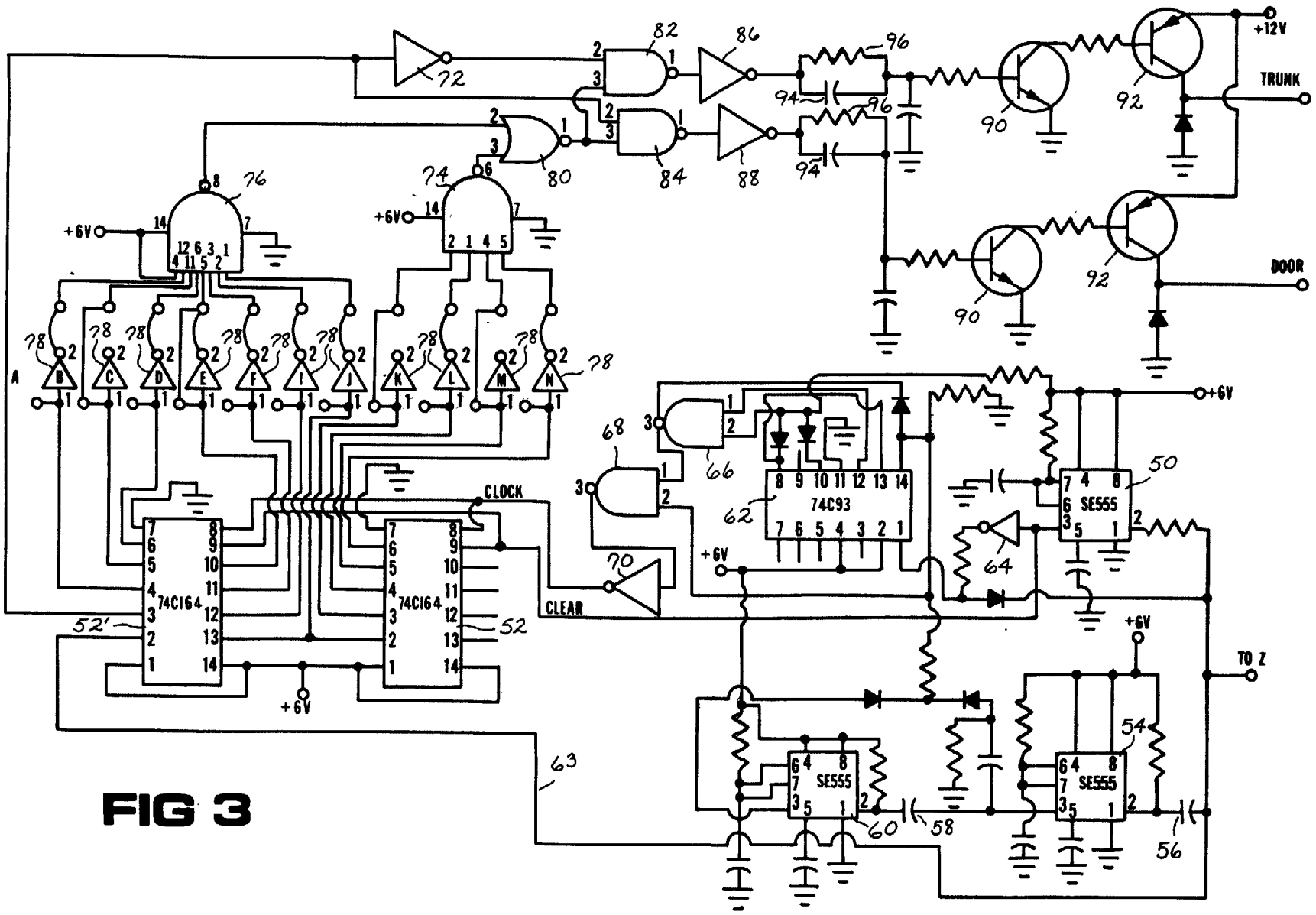
FIG. 3 is a circuit diagram of a decoder and switch actuator utilized in conjunction with the receiver of FIG. 2 and relating to the switch mechanism of the invention.

The receiver circuit illustrated in FIG. 2 is illustrative of a general well known FM receiver of the double conversion superheterodyne type and is used to receive the fourteen bit transmission from the transmitter of FIG. 1 and to reproduce the code for use by the decoder of FIG. 3. It is tuned to the particular 49 MHz frequency of the transmitter. The circuitry of the radio portion of the receiver is well known in the art and is crystal controlled to receive the transmitted frequency of the aforedescribed transmitter. The radio portion of the receiver terminates at pin one of demodulator 36. At this point, the code output is of inverted logic, that is those logic one bits received by antenna 38 of the receiver are a logic zero at pin one and those logic zero bits received by the antenna are of a logic one at pin 1 of the demodulator. By inverting the logic of the bits received at antenna 38, the output of the receiver at pin 1 of demodulator 36 is quieted for every transmitted logic one bit.

That part of the circuit of FIG. 2 between point one of the demodulator 36 and the output Z of voltage comparator 40 to the decoder portion of the switch mechanism forms a self-leveling comparator circuit section. The purpose of the comparator circuit is to accommodate outputs from the demodulator 36 which vary in amplitude due to fluctuations in the strength of the coded logic one signal received at antenna 38 of the receiver. This could be caused by movement of the transmitter of FIG. 1 during transmission of the code.

The comparator circuit section includes voltage comparator 40 and a germanium diode 42 connected between pin 1 or the output of demodulator 36 and pin 3 or the positive input to comparator 40 and a silicon diode 44 connected between pin 1 of the demodulator and pin 2 or the negative input of the comparator. The voltage drop across diode 42 is approximately 2/10 of a volt and the voltage drop across diode 44 is approximately 4/10 of a volt. Thus, when a logic zero bit input is received at antenna 38 and the inverted logic output at pin 1 of demodulator 36 produces a noise voltage, the positive input of conparator 40 will always be at a voltage greater than the negative input of the comparator so as to insure a logic one output at point Z of the radio receiver. When a logic one bit of the code is received by the receiver, there is a quieting of noise at pin 1 of demodulator 36. Capacitor 46 (0.1 microfarad) associated with diode 42 is smaller in size than the capacitor 48 (1 microfarad) associated with diode 44. This means that as pin 1 of the demodulator 36 is quieted or goes to ground upon the receipt of a logic one bit at its antenna 38, the voltage at the positive input of comparator 40 will go to ground more quickly than the voltage at the negative input of the comparator which insures that the output at Z of the comparator will go to a logic zero. The differential voltage level between pins 2 and 3 of comparator 40 will always be 0.2 volts when no code is received at pin 1 of demodulator 36. This self-leveling voltage comparator circuit is therefore independent of the absolute value of the noise voltage at the demodulator output.

DIGITAL DECODER

The digital decoder of the preferred embodiment is illustrated in circuit form in FIG. 3. The first bit of the transmitted code received by the receiver from the transmitter circuit of FIG. 1 and inverted is introducer into the decoder at point Z. This bit is the N bit which is always transmitted in the preferred embodiment as a logic one and received as the encoder as a logic zero. The N bit pulse enters a one shot multi-vibrator 50 which causes pin 3 to go to a logic one. This in turn causes connected pins 9 of the serial to parallel converters or shift registers 52 and 52' to go to a logic one. The duration of the logic one pulse from multivibrator 50 is approximately one second, during which time shift registers 52 and 52' will respond to clocked impulses. After this one second duration, pin 3 of the multi-vibrator and pins 9 of the shift registers will go to a logic zero to clear the shift registers of the clocked in code. While shift registers 52 and 52' are at logic one, the fourteen bit code will be clocked into the registers. This causes the registers to be filled, thereby locking out any additional code input for the remainder of the one second duration multi-vibrator 50 holds pins 9 at a logic one. This prevents would-be unauthorized users from taping in many possible codes until the correct code is randomly utilized. Such an unauthorized user now has to wait a full second after each code input attempt before he can try another code.

A one-shot multi-vibrator 54 has its input pin 2 connected through a capacitor 56 to point Z of the receiver of FIG. 2. Output pin 3 of multi-vibrator 54 is connected through a capacitor 58 to a second one shot multi-vibrator 60. Output pin 3 of multi-vibrator 60 is connected to pin 14 of a counter 62. Also, output pin 3 of multi-vibrator 54 is connected to pin 14 of a counter 62. Recalling that the received code at point Z is inverted from the transmitted code, capacitor 56 which precedes multi-vibrator 54 turns the transition from logic one start to the logic zero of bit N at point Z into a pulse to trigger the multi-vibrator 54, causing the multi-vibrator to stay on for a duration of 1½ bits in length, which in the preferred embodiment is eighteen milliseconds. Serial clocking a bit into shift registers 52 and 52' occurs on the leading edges of the outputs of multi-vibrators 54 and 60. The trailing edge of the pulse from multi-vibrator 54 ending 1½ bits later causes triggering of multi-vibrator 60. Multi-vibrator 60 therefore produces a second leading edge to clock in the next bit in sequence. Its trailing edge occurs within the same bit width so that no further clocking occurs. During this period, the leading edges of the outputs of multi-vibrators 54 and 60 clock the N and M bits respectively, into registers 52 and 52' through line 63. It being recalled that instantaneously before, through the pulsed actuation of multi-vibrator 50, the registers were previously cleared for a one second duration to receive the clocked in code bits. The traling edge of the eighteen millisecond shot from multi-vibrator 54 triggers multi-vibrator 60 which stays on for one millisecond only to complete the clocking in of the M bit into shift registers 52, 52'. No further clocking of the bits into shift registers 52, 52' will occur until another code bit is received at point Z having a logic one there, followed by a logic zero bit. Each transition from logic one to logic zero at point Z will cause the one shot actuation of multi-vibrator 54 followed by the much shorter one-shot duration of multi-vibrator 60 to allow the next two bits of the code to be clocked in the registers. Thus referring to our example code, the initial logic zero to one transition of the N bit will cause bits N and M to be clocked into registers 52 and 52'. The zero to one logic transition between bits M and L will cause bits L and K to be clocked into the registers. The zero to one transition between bits K and J will cause the J and I bits to be clocked in to the registers. The H and G bits will be ignored since they do not follow a zero to one transition within two bits. The G to F bit is a transition from zero to one and thus the F and E bits will be clocked into the registers. The transition between bits E and D is also zero to one and thus the D and C bits will be clocked into the register. The original C bit is always zero and the original B bit is always logic one, so in each combination of the example code, the logic zero to one transition between the C and B bits guarantees that the A bit will be clocked into the registers.

Counter 62 is actuated by the pulse provided by multi-vibrator 50. Pin 3 of the multi-vibrator is connected to pin 1 of the counter through an inverter 64 which insures that the pulse is of a logic zero at pin 1 of the counter to activate the counter. Counter 62 serves to permit a maximum of twelve bits to be gated into registers 52 and 52'. In the preferred embodiment, there will always be two bits of the original fourteen bit code which will be ignored and not gated into registers 52 and 52'. A NAND gate 66 is connected to clock 62 so as to go to a logic zero when the clock reaches the maximum twelve counts. When this occurs, NAND gate 68 goes to a logic one which in turn causes connected inverter 70 to go to a logic zero. As inverter 70 goes to a logic zero, the clocking to registers 52 and 52' is terminated so that no additional shifting within the registers of the gated in bits occurs.

Upon termination of the clocking, the bits within registers 52 and 52' appear at the inputs of inverter 72 and NAND gates 74 and 76. The bit representing the original A bit of the code but in its inverted form passes through line A to inverter 72. For explanation purposes we will assume that the original user of the transmitter of FIG. 1 wished to unlock the door of his vehicle, and thus he pushed that switch 14 of the transmitter which is associated with the door, thereby causing A to assume an original logic zero. Thus the bit representing A is a logic one at the input of inverter 72 and appears as a logic zero at the input pin 2 of NAND gate 82. For each of the remaining eleven bits gated into registers 52 and 52' there is an inverter 78 provided between the specific register and its associated NAND gate 74,76. For illustrative purposes, each of the inverters 78 are labeled with a letter representative of the original lettered bit of the code. For the example code, the input to the inverter 78 representing the B bit will be logic zero or in inverted form from the original code logic one and will appear at one of the inputs into NAND gate 76 as logic one. Likewise, for each of the inverters 78 representing bits C-N of the example code, the bits received at the inverters in their inverted form from the original code will be respectively, one, zero, one, zero, zero, zero, one, zero, one, and zero. Those bits which are logic zeros at their respective inverters 78 are inverted to a logic one, thereby enabling all inputs to NAND gates 74 and 76 to be logic ones with the resulting output of both NAND gates being logic zero. The number of inverters 78 will vary depending upon the bits which are selected to be gated into registers 52 and 52'. The associated inverters 78 are then hard wired to accommodate the selected code thereby enabling the inputs to NAND gates 74 and 76 to be all logic one. For any selected bit code of a fourteen bit combination, the number of bits gated into registers 52 and 52' can be varied. Additionally, the pulse duration of multi-vibrators 54 and 60 can be varied in length so as to selectively gate in additional bits for each transition from logic zero to logic one of the selected code.

A NOR gate 80 receives the logic zero inputs from NAND gates 74 and 76 to cause a logic one input at NAND gates 82 and 84. Additionally, assuming that the user of the transmitter of FIG. 1 wishes to open his car door, the logic zero output of inverter 72 becomes one of the inputs to NAND gate 82 and the input logic one to inverter 72 becomes one of the inputs into NAND gate 82. The output of NAND gate 82 will be a logic one and the output of NAND gate 84 will be a logic zero. These outputs become inputs to inverters 86 and 88 with the output of inverter 88 being a logic one and that of inverter 86 a logic zero. To the output of each inverter 86 and 88 are connected a pair of power transistors 90 and 92. Each pair of transistors 90 and 92 form a switch device for actuating a solenoid (not shown) or similar mechanism for operating the latch of the trunk or car door. Therefore in our example code, as inverter 88 goes to logic one, its connected transistors 90 and 92 will be turned on to actuate the latch opening mechanism for the door. Inverter 88 remains in a logic one state until the one second pulse duration of multi-vibrator 50 is completed at which time output pin 3 of the multi-vibrator goes low and clears registers 52 and 52'. At this time the outputs of inverters 86 and 88 both assume a logic zero. The purpose of capacitor 94 and resistor 96 connected in parallel between the output of each inverter 86, 88 and the base of associated power transistor 90 is to pulse the transistors to cause actuation of the trunk or door latch. This prevents the transistor switches from remaining on during the remainder of the one second actuation duration of multi-vibrator 50, thereby preventing burnout of any solenoid latch actuator and overheating of the transistors.

The remote control electronic switch described provides a highly securable code of multiple variations. A lockout function such as that provided by multi-vibrator 50 prevents multiple insertions of codes into the decoder of the switch, further improving the security of the switch. The transmitter of the switch may be powered by a small six volt battery having minimal power drain during operation and can be fabricated in miniaturized form. While the illustrated embodiment has been explained as a switch for actuating car doors or trunks, it is to be understood that this invention may be utilized for switching many types of devices where a high security access code is required or is desirable. Accordingly, it is to be understood that the invention is not to be limited to the details above given but may be modified within the scope of the appended claims.

What I claim is:

1. A switch mechanism actuated by a remotely transmitted binary digital code of a multiple number of parts in a specific sequence and each of a logic zero or a logic one value, said switch mechanism comprising a remote transmitter and a receiver means and a decoder, said transmitter including oscillator means for providing a carrier signal and actuator means for causing actuation of said oscillator means in response to the code part sequence to produce a signal pulse for each logic one code part with the oscillator means being turned on and off for selected durations whereby said signal pulses and the absence thereof constitute code bits of logic one and logic zero values respectively, said receiver means for receiving said code bits from said transmitter and relaying said bits to said decoder, said decoder including a switch actuator and means for receiving selected ones of said code bits from said receiver and converting said selected code bits through gating means into an actuating pulse to actuate said switch actuator, said receiver including a voltage comparator having a negative input and a positive input and an output, said output connected to said decoder, a first diode having its cathode connected to the comparator positive input and its anode connected to receive said code bits transmitted from said transmitter, a second diode having its cathode connected to said comparator negative input and its anode connected to receive said code bits transmitted from said transmitter, the voltage drop across said first diode being less than the voltage drop across said second diode whereby the positive input of the comparator will be at a voltage greater than the negative input of the comparator to provide a logic one input into the decoder for each logic one input into the comparator independent of the code bit voltage strength at the comparator inputs, a first capacitor associated with the cathode of said first diode and a second capacitor associated with the cathode of said second diode, said first capacitor having a capacitance less than the capacitance of said second diode whereby the transition between logic one and logic zero bits at said diodes causes said second capacitoı to assume a logic zero condition after the first capacitor thereby providing a voltage at the comparator negative input and a logic zero input into the decoder.

* * * * *